US006029382A

United States Patent [19]

Kochanowski

[11] Patent Number: 6,029,382

[45] **Date of Patent: *Feb. 29, 2000**

[54] REFLECTIVE SIGN

[76] Inventor: George E. Kochanowski, 5066 NW. 90th Ter., Coral Springs, Fla. 33067

[ * ] Notice: This patent is subject to a terminal disclaimer.

[21] Appl. No.: 08/472,332

[22] Filed: Jun. 7, 1995

Related U.S. Application Data

[63] Continuation-in-part of application No. 08/119,291, Sep. 8, 1993, Pat. No. 5,442,870.

[51] Int. Cl.[7] ..... G09F 13/16

[52] U.S. Cl. ..... 40/582; 40/612; 362/329

[58] Field of Search ..... 40/582, 612, 616, 40/606, 607; 362/268, 329, 812; 359/515, 527, 531, 547, 552

[56] References Cited

U.S. PATENT DOCUMENTS

| | | | |
|---|---|---|---|
| 1,719,602 | 7/1929 | Eskilson | 40/582 X |
| 2,076,907 | 4/1937 | Meigs | 40/607 X |
| 3,768,434 | 10/1973 | Pinter | 359/547 X |
| 4,221,498 | 9/1980 | Schueler et al. | 40/612 X |
| 4,726,706 | 2/1988 | Attar | 359/531 X |
| 5,442,870 | 8/1995 | Kochanowski | 40/582 |

FOREIGN PATENT DOCUMENTS

| | | | |
|---|---|---|---|
| 2254826 | 10/1992 | United Kingdom | 359/515 |

*Primary Examiner*—Brian K. Green
*Attorney, Agent, or Firm*—Malin, Haley & DiMaggio, P.A.

[57] ABSTRACT

A retro-reflective sign is provided having a front face member attached to a back member. The face member has a plurality of cube corners disposed along its back surface. The sign can be of any shape or color and provides superior light reflection at night as compared to conventional signs. Thus, the sign can be easily seen while driving at night. In an alternative embodiment, the cube corners are disposed along the inner surface of the back member. The front face member or the entire sign can be coated with a silicone material to provide added protection to the sign from scratching and vandalism. A side wall can be provided between the front face member and the back member to define a gap area therebetween. Several sign to a post attachment embodiments are also provided.

21 Claims, 9 Drawing Sheets

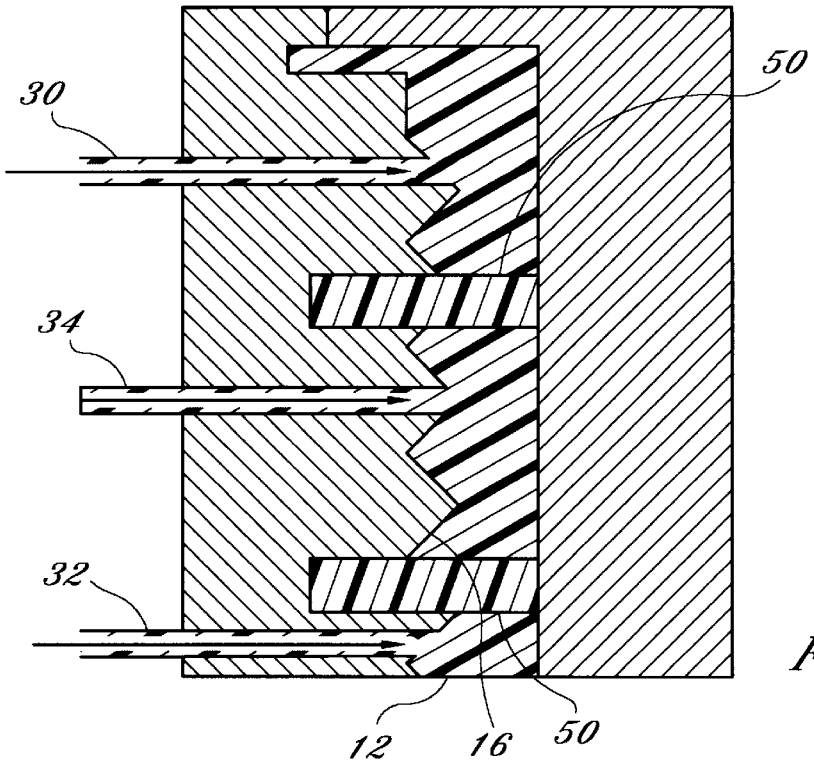
Fig. 8
Fig. 9
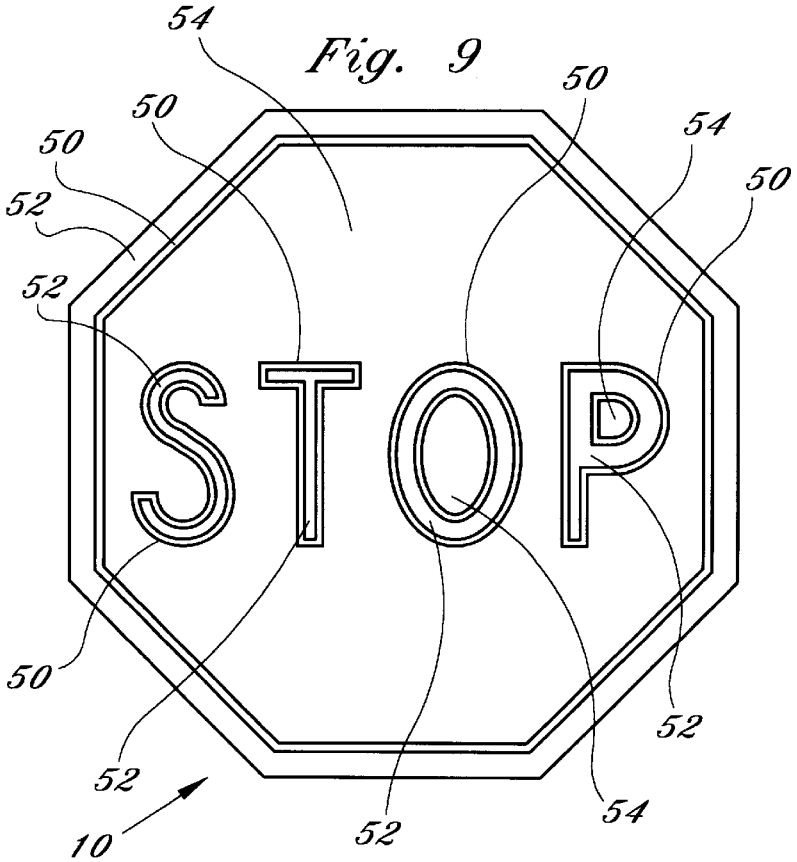
Fig. 10
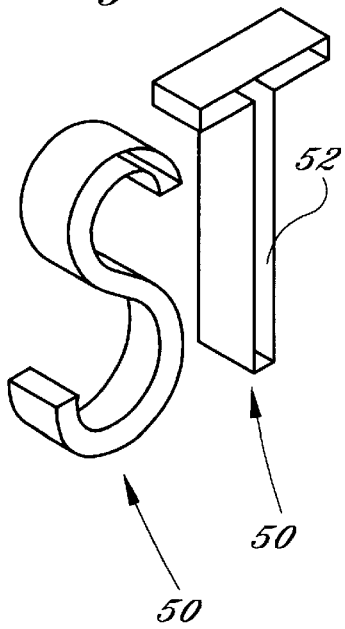

REFLECTIVE SIGN

This application is a continuation-in-part of U.S. application Ser. No. 08/119,291, filed Sep. 8, 1993, now U.S. Pat. No. 5,442,870.

BACKGROUND OF THE INVENTION

1. Field of the Invention

This invention relates generally to reflectors and in more particular to an improved reflective sign for uses such as roadside traffic signs.

2. Background of the Invention

With the dawn of the automobile came the need for traffic control devices. Originally, each traffic sign was cut to a unique shape for identification. Since electricity was not wide spread, painted signs were used for traffic control. With the increase of automobile use around the clock, the traffic signs began to be painted with as reflective a paint available for viewing at nighttime. Initially, the reflective paint was used on wooden signs and then on more durable signs constructed of metal, including laminated signs. Presently, roadway signs have been constructed using tiny glass beads added to the paint or incorporated into sheeting products to increase overall reflectivity.

Examples of the use of glass beads include U.S. Pat. No. 2,379,741 issued to McKenzie; U.S. Pat. No. 3,065,659 issued to Palmquist; U.S. Pat. No. 3,494,912 issued to Mitsuo Toyama et al.; U.S. Pat. No. 3,877,786 issued to Booras et al.; U.S. Pat. No. 3,922,433 issued to Patterson et al.; U.S. Pat. No. 3,934,065 issued to Tung; U.S. Pat. No. 3,994,086 issued to Mizuochi; U.S. Pat. No. 4,025,674 issued to Mizuochi; U.S. Pat. No. 4,082,426 issued to Brown; U.S. Pat. No. 4,099,838 issued to Cook et al.; U.S. Pat. No. 4,519,154 issued to Molari, Jr.; U.S. Pat. No. 4,544,586 issued to Molari, Jr.; U.S. Pat. No. 4,555,161 issued to Rowland; and U.S. Pat. No. 4,995,185 issued to Cheng.

The current state of the art is to put the beads on a paper or web backing and cover with a thin laminate. The other side of the paper or web is coated with a special adhesive so it will stick to the aluminum. A further enhancement is to use a heat activated adhesive to improve the bonding. In this process, the aluminum is heated and the paper or webbing sticks to it. Signs out in the field use stickers put on metal backing, and are painted with a message, design, symbol, etc. or combinations thereof, i.e. STOP, WRONG WAY. Once the sticker is on, the sign is ready for stencil and paint. However, when painting the sign, a minimal amount of paint is utilized to avoid covering up the reflective media. Presently, the colorant or paint is included on the inside of the laminate. However, during the heating process the paint on the inside of the sticker becomes damaged. Additional damage occurs during the installation in the field. When the sign is fastened to a sign post, the bolt cuts small slits into the laminate. Thus, moisture is allowed to get into the sign, and with normal daily temperature swings, the signs begins to de-laminate and within weeks, the sign is ruined.

Other examples of reflective roadway signs and markers include the following:

(1) U.S. Pat. No. 5,050,327 issued to Woltman discloses a sign having a face bearing an informational legend thereon. The face is made up of one or more legend portions and one or more background portions. The legend and background portions define cross-sectional segments of the sign. At least part of at least one of the legend segment or background segment is both retro-reflective and translucent. Typically, the legend and background portions of the face are of contrasting colors to enhance the legibility of the information displayed on the sign. The backing member of the sign must be translucent or transparent in at least any segment of the backing member which is part of the translucent segment of the sign. This sign is better seen at night than conventional signs only when the sign is backlit.

(2) U.S. Pat. No. 3,409,344 issued to Balint et al. discloses a roadway reflector comprising a hollow housing which has inclined side and end walls and a flat top wall. The housing is molded in situ about the periphery of previously molded reflective inserts so that the inserts are in the end walls. The inserts have substantially flat outer surfaces and a plurality of retro-reflective prisms on the inner surfaces thereof, the axes of the prisms forming an angle with the plane of the insert and in turn with the pavement when the marker/reflector is in position such that the light beams from the automotive vehicle are reflected back to the eyes of the driver.

Another example of a reflective figure is U.S. Pat. No. 3,772,810 issued to Kupperman et al. The Kupperman reference discloses a figure having a recognizable form, formed and molded of a reflecting material to provide a substantially rigid body having a front side and a back side. The back side is formed to provide prismatic surfaces. The back side also has adhesive means which permits the figure to be secured and supported on a supporting surface. Thus, a light beam that is directed against the front side wall, passes through the body to strike the prismatic surfaces and produces a variegated reflected pattern. The front side of the figure may have a message impressed or imprinted thereon. The Kupperman reference fails to show the message as being part of the face member. Thus, as the message forms its own layer, separate from the face member, it is subject to vandalism, as well as the weather elements. Kupperman utilizes only one color which precludes the ability to add emphasis or create a distinctive message within the body of the figure.

Another problem in the art is attaching a sign, such as a conventional STOP sign, to a conventional metal post, "U" channel post, or wood post. A standard STOP sign has either two or four holes that a bolt passes through to attach the sign to the post. The act of using a wrench to tighten the bolt causes damage to the bolt, and with time rust forms. Shortly thereafter, the rust runs down the face of the sign, making the sign look older prematurely.

Though nearly a century has passed since the use of automobiles as way of transportation began, adequate traffic signs, especially for easy viewing at night, are still missing in the art. Thus, what is needed in the art is a sign having increased reflective means for greater viewing at nighttime as compared to present conventional signs. In addition, the sign needs to be more durable and able to last longer than signs presently in use. It is therefore, to the effective resolution of the aforementioned problems and shortcomings that the present invention is directed.

SUMMARY OF THE INVENTION

Generally, the present invention relates to a reflective sign, constructed of plastic, and having a face member and a back member. More specifically the present invention uses the technology of retro-reflectance. Reflectors which return light into the immediate neighborhood of its source, regardless of the position of that source, are called retro-directive reflectors. Literally, retro-directive reflection means exactly reversing the direction of each ray of light, sending it back along either its original path or a parallel one. An ideal retro-directive reflector would thus return most of its light received from a particular source back into the source itself. However, the ideal retro-directive reflector constitutes a theoretical limiting case of no practical value. The practical retro-directive reflector differs from the ideal one in giving to the return beam the conical shape required to reach the eyes of an observer.

One type of retro-directive reflector is the triple reflector. The triple reflector has three plane reflecting surfaces arranged so that each is perpendicular to the other two, e.g. similar to the floor and two adjacent walls of a room meeting at a corner. Thus, any ray of light which has been reflected successively from all three surfaces will be exactly reverse in direction.

Using a stop sign as an example, the face member is molded with the appropriate amount of red color pigment of the sign, and the area where the words or symbols and the border are kept clear or water white. The entire back of the face member contains reflective means such as cube corners. The plastic can have ultraviolet (UV) stabilizers added to inhibit fading of the color pigment from the sunlight. The back member can be virtually opaque. The interior finish of the back member is very smooth and glossy and can be almost mirror like. Light that passes through the face member gets reflected back through the sign and provides a near back lit effect, thus, increasing one capability to see the sign in the dark. Lastly, the sign can be coated with a silicone based product. This coating will increase the UV stability and also makes the surface of the sign harder to reduce the amount of chalking, dusting and scratches. The silicone coating also makes the sign more vandal resistant as paints will not permanently adhere to the treated surface.

An another alternative embodiment for the present invention sign includes a face member, which can be molded into a specific message, and incorporating reflective means; a non-opaque back member providing a second reflecting means, and that makes the sign readable only from the front; and a gap that is created by separating the front from the back. The gap size can be controlled by a system of support members and a side wall also made of plastic, such as polycarbonate or acrylics, that are molded into a system of optical lenses, which enhance the light entering the sign, and ignite the optical prescriptions (the various prismatics for retro-reflection, and other reflecting surfaces) incorporated throughout the sign. Furthermore, various embodiments for attaching the sign to a conventional post are provided.

Accordingly, it is an object of the present invention to provide a reflective sign which will be brighter at night than conventional reflective signs.

It is another object of the present invention to provide a reflective sign which is easily seen at night as compared to conventional reflective signs.

It is an additional object of the present invention to provide a reflective sign which will last longer and is more durable than conventional reflective signs.

It is yet another object of the present invention to provide a reflective sign which is constructed from plastic.

It is a further object of the present invention to provide a reflective sign which can be completely recycled to make replacement reflective signs.

It is still another object of the present invention to provide a reflective sign which is relatively low in cost and easy to manufacture.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to he drawings in which:

FIG. 8 is a front view showing the an alternative molding process for the front face member;

FIG. 9 is a front view of the present invention constructed from the alternative molding process of FIG. 8;

FIG. 10 is a perspective view of two prefabricated letters in accordance with the alternative molding process;

DETAILED DESCRIPTION OF THE PREFERRED EMBODIMENT

Figure 1:
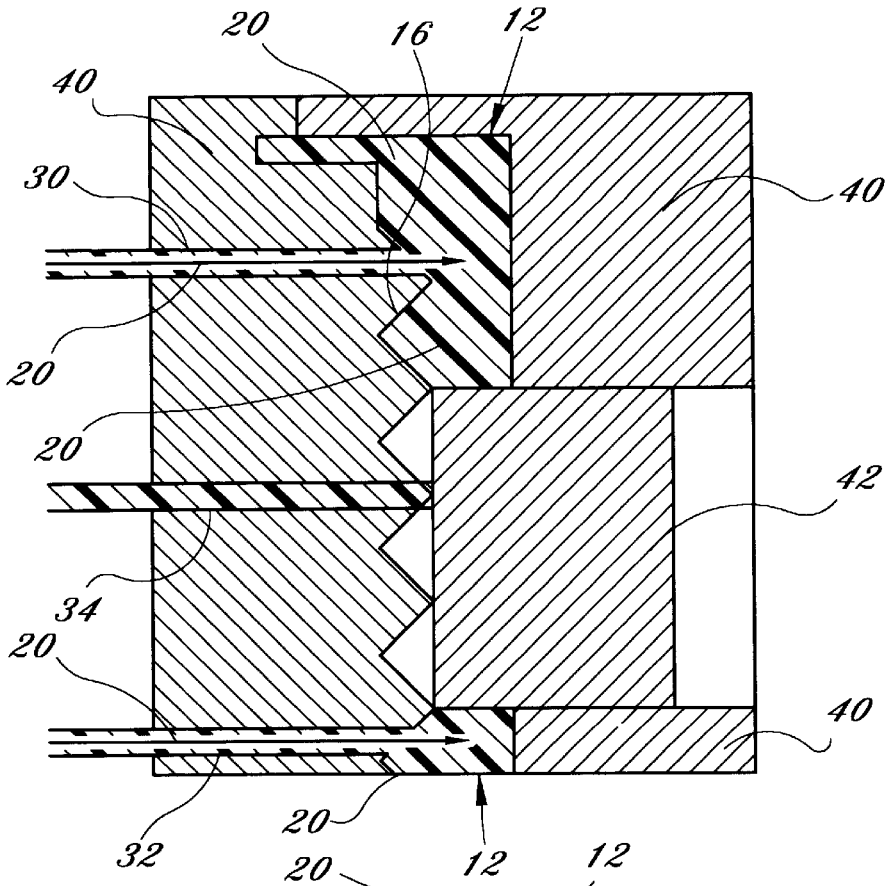
FIG. 1 is a front view showing the first step of the first molding process for the front face member.

As seen in the drawings the present invention shows an improved reflective sign constructed from a molding process to be discussed below. The sign, generally shown at 10, is constructed from two pieces of plastic and includes a front or face portion 12 and a back portion 14. Preferably, a strong but flexible plastic is utilized in the construction, i.e. a polycarbonate such as the MAKROLON or LEXAN brands. However, other plastics or combinations of plastics and materials which have similar characteristics to polycarbonates may be utilized for the construction of the reflective sign. The designed thickness of the face member 12 not only provides the sign 10 with rigidity, but it also provides the area to incorporate cube corners 16, which increase the reflectivity of the sign.

Figure 2:
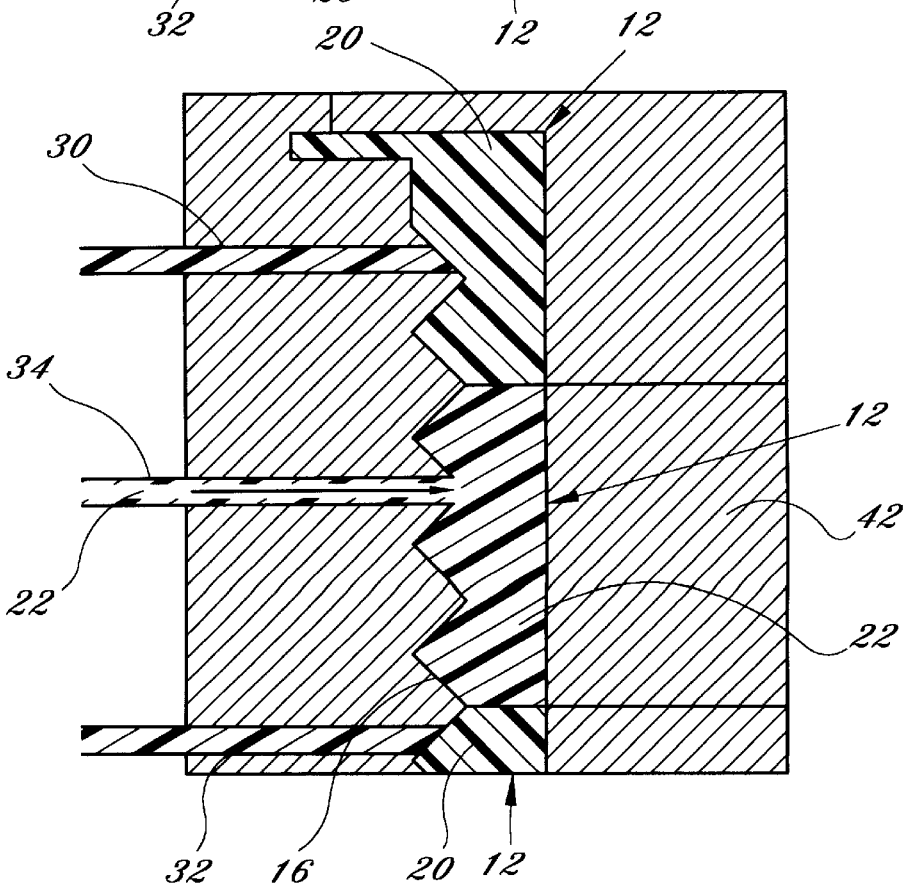
FIG. 2 is a front view showing the second step of the first molding process for the front face member.
Figure 3:
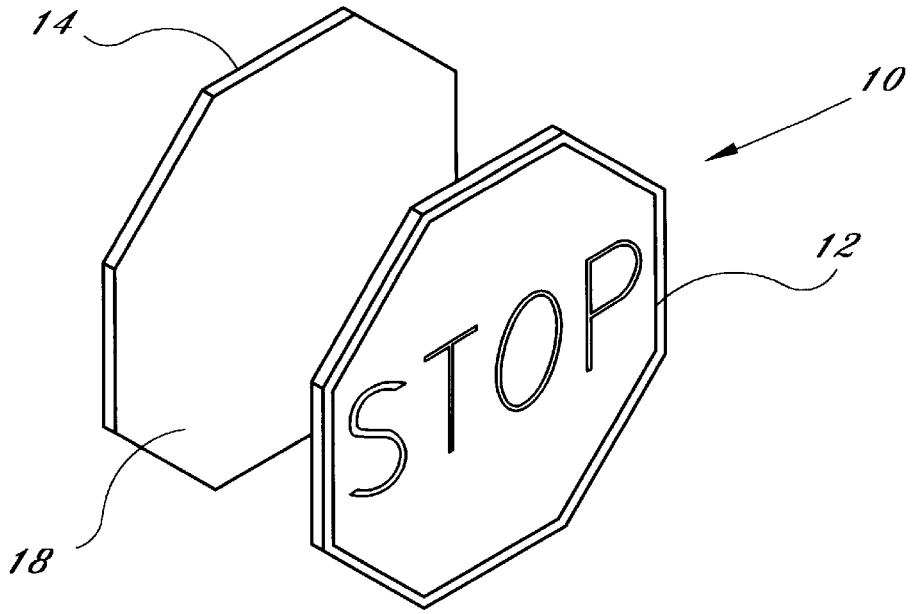
FIG. 3 is an exploded view of the present invention.
Figure 4:
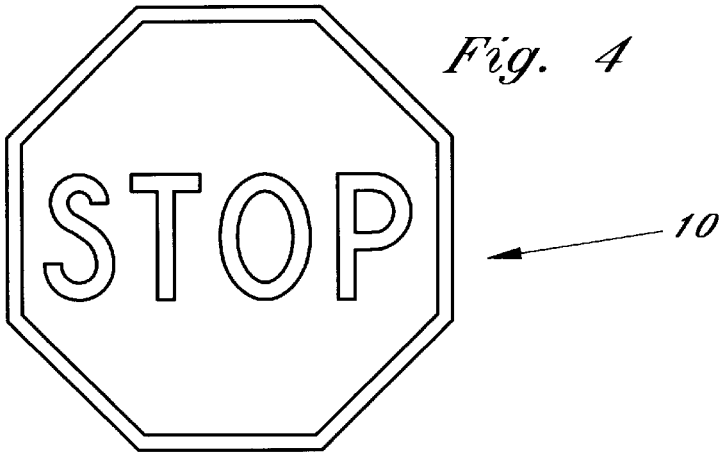
FIG. 4 is a front view of the present invention.
Figure 5A:
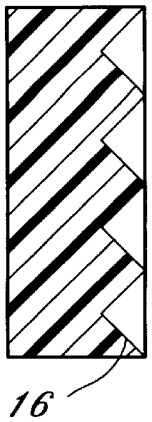
FIG. 5A is a side view of a portion of the cube corners in accordance with the present invention.
Figure 5B:
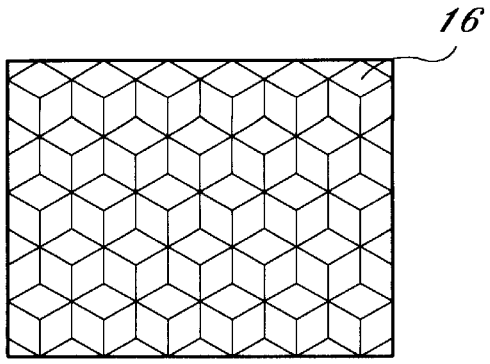
FIG. 5B is a front view of the cube corners shown in FIG. 5A.
Figure 6:
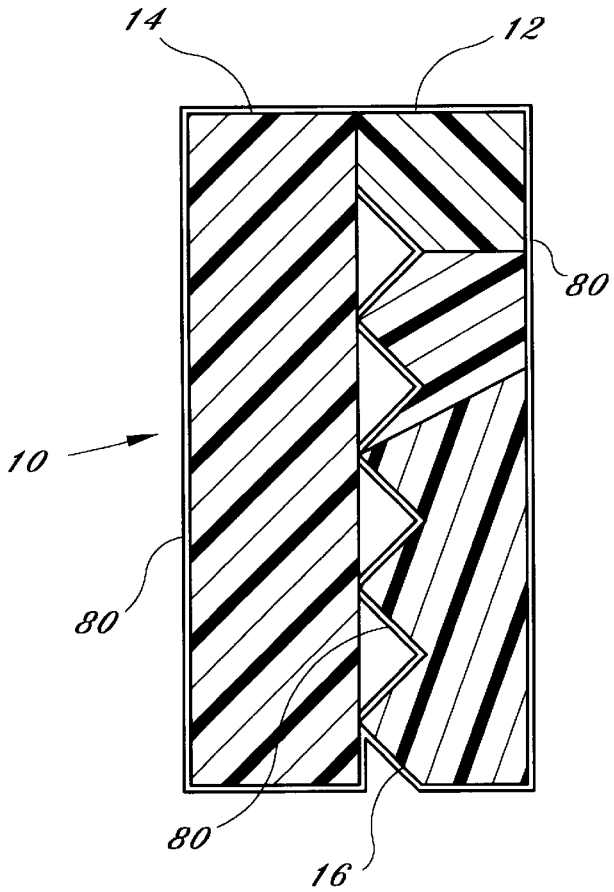
FIG. 6 is a side view showing a portion of the first embodiment of the present invention having three different colors.

Now describing the sign construction process for a sign requiring two colors (FIGS. 1 and 2), a first polycarbonate 20 is injected through cavities 30 and 32 into the mold 40 to the areas of the face of the sign according to the design of the sign. Specifically, one of the two colored plastics is injected. This will be referred to as the 1st shot. It is to be understood that more than two cavities can allow the flow through of the first polycarbonate, and which cavities are used and the number of cavities is determined by the design of the sign. The area where the other color for the sign will go, and the end of the cavities associated with such area, are blocked off by blocking or separating means 42 during the injection of the first color polycarbonate to avoid any of the first color from entering this area of the design. After the first plastic (polycarbonate) 20 sets up or hardens, the mold is manipulated to accommodate the flow of the other colored or clear plastic. As seen in FIG. 2, the blocking means 42 is pulled back to open cavity 34 and allow the second plastic 22 to go through and complete the construction of the face member 12. After the first plastic 20 hardens it acts as a blocking member to cavities 30 and 32, thus not allowing the second plastic when injected to go through cavities 30 and 32 and enter the area of the design designated for the first plastic 20.

The mold 40, now altered by the hardening of the first plastic 20 and the pulling back of the separating means 42, accepts the second plastic 22 to fill the available cavities associated with the area of the face of the sign designated for the second plastic. This will be referred to as the 2nd shot. In this example only two different color plastics are required, however, it is to be understood that this process could be utilized for numerous amounts of different color plastics utilizing appropriated amounts of blocking members 42 and previously hardened color or clear plastics to only allow the flow of additional color or clear plastics into the mold at designated areas of the face of the sign according to the sign design. In such cases, the additional plastics would be referred to as the 3rd shot, 4th shot, etc. Once all the plastics have cooled the face member 12 of sign 10 is removed from the mold 40.

An alternative process to the one described above is to remove the 1st shot (first color plastic 20 after it has hardened) and move it to a second independent mold (not shown) for injection of the 2nd shot (second color plastic 22). Since the two shots are from the same base material (only differing in color pigment), the two shots melt into each other making the face member 12 into one final piece. The face portion 12 is molded with the appropriate amount of color pigment, and the area where the words or symbols are to be located can be kept clear or be made of other pigmented plastics with contrasting colors. From the mold design, the entire back of the face member 12 contains a plurality of cube corners 16.

However, in either of these processes, the mold is designed to provide a plurality of cube corners 16 on the entire inner surface of the face member 12. Though it is preferred to have the cube corners 16 disposed on the entire back surface of face member 12, the present invention is not limited to such. Thus, it is within the scope of the invention to provide a plurality of cube corners 16 on a substantial, but not entire, portion of the back surface of the front face member 12. Each cube corner 16 is a form of the triple reflector described above. The cube corners 16 are a mosaic of 90-degree triangular pyramids which are formed from the mold design to provide excellent night time visibility of the sign.

Once the face member 12 is removed from the mold 40 it is attached to a back member 14. Preferably, the back member 14 is previously stamped or molded to the correct shape of the sign 10 to accept the face member 12. The face member 12 can be attached to the back member 14 by several different methods including clips, glue, adhesive, snaps, ultrasonic means. However, it is to be understood that the invention is not limited to the these identified attaching methods and that other conventional attaching methods not listed are within the scope of the present invention.

Finally, the face member 12 of the sign 10 is coated with a Silicone surface hardener 80, and cured. In addition to the face member 12, to provide more protection to sign 10, the entire sign can be coated with the Silicone surface hardener 80. The Silicone coating seals the sign 10, and protects it from the UV light of the sun. The silicone coating also makes the surface harder, making sign 10 vandal resistant while keeping its outward appearance glossy and clean. Thus, the present invention provides a more reflective, durable sign as compared to conventional signs.

In lieu of the silicone coating, an environmentally favorable chemical compound such as a solid plastic alloy of TEFLON or TEFLON like anti-stick compounds, and a polycarbonate or acrylic can be introduced in the molding process to add surface qualities to inhibit UV light, or act as a barrier to surface paints and adhesives. With the addition of one or more of these chemical compounds, sign 10 can be solvent cleaned without damaging the internal pigments that create the sign's message, thus allowing the refurbishing of the sign in the field to extend its useful life. In another embodiment, the chemical compounds are provided within the resin, and the sign is provided with a silicone surface hard coat.

Thus, the sign is preferably constructed from all plastic. There is no paint, aluminum backing, reflective sheeting or sticker. The entire face member 12 of sign 10 is the sign and not a sticker adhered to a backing plate such as metal, wood or even plastic, as with prior art signs, i.e. STOP signs, etc. The letters, symbols, and colors of the sign design are molded together out of the plastic (polycarbonate) with the inner or back surface of the face member 12 molded into cube corners 16. Sign 10 has excellent retro-reflecting properties as compared to prior art signs. Furthermore, scratching sign 10 will not inhibit the retro-reflectance properties as the cube corners 16 are on the inside, and the coating materials utilized do not readily accept exterior paint materials.

For illustrative purposes only, in describing the present invention, a stop sign will be used, where appropriate, as the example for the sign design. However, as will be seen below, the present invention can be used to construct any type of sign, regardless of shape or color, requiring retro-reflectance.

Using the stop sign as an example, the molding process will now be described. The polycarbonate (having a red pigment) is injected through cavities into a mold. Thus the face member 12 is molded with the appropriate amount of red pigment, and the area where the word (STOP) is located on the face is kept clear. Once hardened, a clear plastic (polycarbonate) is injected through the cavities into the areas where the word STOP is located as well as the border area of the sign. The hardened red polycarbonate acts as a blocking means to prevent the clear plastic from entering these areas of the face member 12. The entire inner or back surface of the face member is molded into cube corners 16.

In use, the biggest concern with stop signs is that the red pigment will fade due to the ultraviolet (UV) light coming from the sun. However, the plastic (polycarbonate) will have UV stabilizers added to inhibit this fading. Additionally, the thickness of the face member 12 is such that there is significantly more red pigment that in a common STOP sign that simply paints a red coating on a reflective sticker. The additional pigment also increases the life of the sign 10 in the field.

The back member 14 of the STOP sign 12 is also made out of plastic, preferably Polycarbonate, and is virtually opaque. The interior finish of the inner surface 18 of the back member 14 is very smooth and glossy, almost mirror like to create a reflective surface. Alternatively, a MYLAR brand film, shiny paper or metallic layer may be disposed on the inner surface of the back member 14 to create the reflective surface. In this way any light that passes through the face member 12, will get reflected back through the sign to provide a near "back lit" effect. Thus, one's capability to see the sign 10 in the dark is greatly increased. Furthermore, an electrical light source can also be provided on the sign to increase the amount of light being reflected back from the glossy or mirror like surface. Finally, the entire sign 10, can be coated with a silicone based product. The silicone coating increases the UV stability of the red pigment and the polycarbonate itself. An additional advantage is that the silicone coating makes the surface of sign 10 harder, thus reducing the amount of chalking, dusting, and scratches to the sign 10. The silicone coating also makes the sign vandal resistant as some paints will not permanently adhere to the treated surface.

In a first alternative embodiment the reflective surface (i.e. MYLAR brand film, shiny paper or metallic layer, etc.) can be disposed or deposited onto cube corners 16 to provide special reflection. After applying the reflective surface to the cube corners 16, the cube corners 16 can be sealed to eliminate the need for a back piece.

In a second alternative embodiment (FIG. 7), the cube corners are disposed on the back member 14 instead of the face member of the sign. Thus, the inner surface and the outer surface of the face member are basically flat. The process for making the face member is still the same as described above except for the cube corners design in the mold is eliminated. This alternative embodiment has all of the advantages of the first embodiment of the present invention.

In a third embodiment, the face member is clear or water white and either the inner surface of the back member or the inner surface of the face member contain the cube corners. In this embodiment a relatively rigid film having a printed or painted message is inserted. The paint can be translucent or opaque as needed. An example for this third embodiment, would a "Speed Limit" sign, where the "speed limit" may change over time due to a change in driving conditions (i.e. construction zones). An operator can manipulate the sign, remove the message, and replace it with a different message. After the changed driving conditions (i.e. construction) are completed, the original message can be re-inserted, thus making better use of the sign installation. Similar to the above, the back member could be eliminated and the reflective surface deposited onto the cube corners.

A second alternative process for the sign design involves the use of prefabricated mold shapes 50 to separate the different colors of the sign design. Using a STOP sign again as an example (FIGS. 7 through 10), the prefabricated shapes 50 are constructed by injecting plastic into a mold to make the outline of the letters, design or other symbol (e.g. the letters S, T, 0 and P and the outer border region of the STOP sign) according to the sign design. The prefabricated shapes provide supporting walls, and a means to segregate or separate the colors used for the sign design. In this process the separating means 42 described above are no longer needed as the prefabricated shapes inherently provide such function.

To make the prefabricated shapes 50, plastic is injected into a first mold designed to make the outline of the letters and symbols required by the sign design. The plastic material and color used for the prefabricated shapes 50 is the same as the plastic used for the face member 12 of the sign. Thus, the plastics will blend in perfectly with each other and will make a seamless joint. Once cooled, and cleaned of residual plastic, the shapes are inserted into a second mold to make the face member of the sign.

Figure 7:
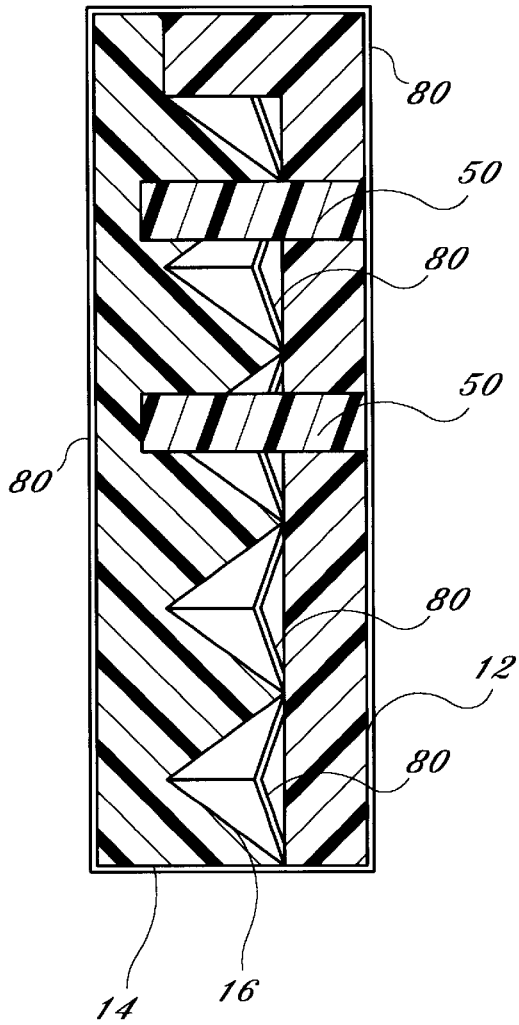
FIG. 7 is a side view showing a portion of the second embodiment of the present invention.

Using the stop sign as an example, by the use of the prefabricated shapes 50, both the red plastic and the clear plastic can be injected into the mold at the same time. The clear plastic is poured within the area 52 between the separating walls of the letters "S", "T", "O" and "P" and the outer borders, while the red plastic is poured within the area designated 54. In this second mold, the cube corners 16 are constructed in a similar fashion as to other processes described above. The cube corners 16 can be disposed on either the face member 12 (FIG. 8) or the back member of the sign (FIG. 7). When disposed on the face member 12, the cube corners are disposed on the entire inner surface of the face member 12 except where the prefabricated shapes 50 are located. However, this area is minimal and does not affect the reflectivity properties of the sign 10.

Thus, this second alternative process provides a more practical method of constructing the retro-reflective sign of the present invention. Additionally, the prefabricated shapes 50 provide additional areas for joining the face member 12 to the back member of the sign 10, thus, increasing the rigidity of the sign 10.

In operation as a STOP sign, the light, such as a car's headlights at night, will hit the sign. Some light will immediately reflect back from the red and water white or clear areas of the STOP sign. However, some light does not get reflected back but passes through the face member 12 of the STOP sign through tiny cracks between the cube corners and becomes captured between the back member and the face member. This light hits the glossy or mirror like finish of the inner surface of the back member and reflects back and hits the cube corners. The cube corner diffuses the lights, held captive between the back member and the face member, in various direction to allow the driver of the automobile to easily see the STOP sign. Thus, the present invention allows the driver to see the STOP sign well in advance of approaching the STOP sign in order to safely stop before entering the corresponding intersection or roadway. Furthermore, the STOP sign will stay red much longer than conventional STOP signs due to its larger amount of red pigment. As the sign, can be constructed entirely from plastic or thermoplastic, it is recyclable and thus, can be reused to construct additional signs in accordance with the present invention. The silicone coating applied to the sign helps to prevent destruction of the sign from the likes of vandalism, scratching, sunlight, etc.

The present invention can be utilized for any sign which requires retro-reflectance, regardless of the size of the sign. The present invention can accommodate any symbols in the face portion of the sign, including any letters, and can be any shape or color, or any combination of shapes or colors. Therefore, the present invention can be utilized for any traffic sign as well as any sign requiring retro-reflectance.

However, the present invention is not limited to signs and can be utilized for other objects and items requiring retro-reflectance. Further, though the present invention has been described with the use of cube corners as the reflective means, it is to be understood that other triple reflectors as well as reflective means may be utilized in place of the cube corners. It should also be understood that other design combinations using the features of the present invention are possible and are within the scope of this invention. Furthermore, while it is preferred that the entire sign be constructed from plastic, this is not limiting, and other materials such as glass, fiberglass or metal may be utilized.

Figure 11:
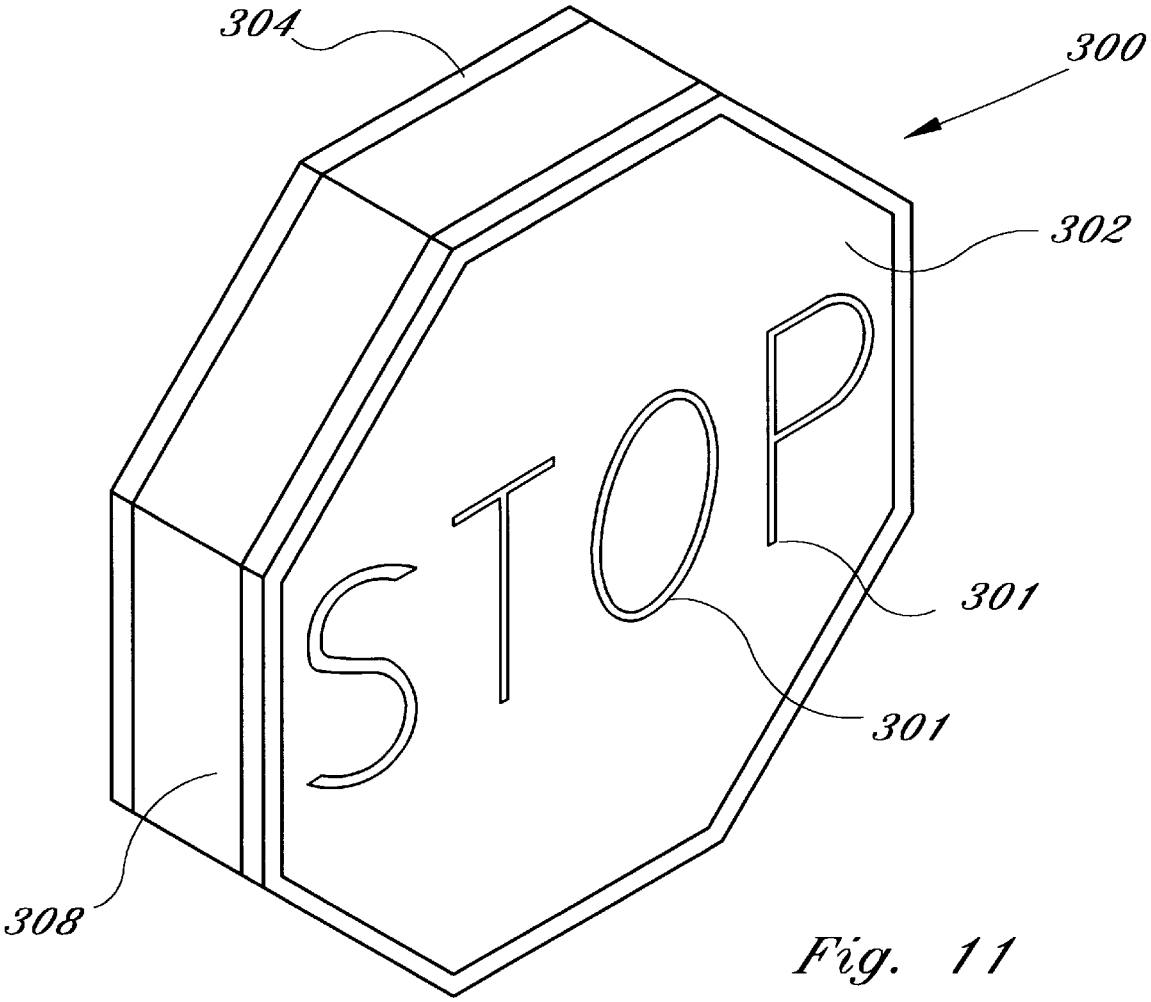
FIG. 11 is a perspective view of an alternative sign embodiment of the present invention.
Figure 12:
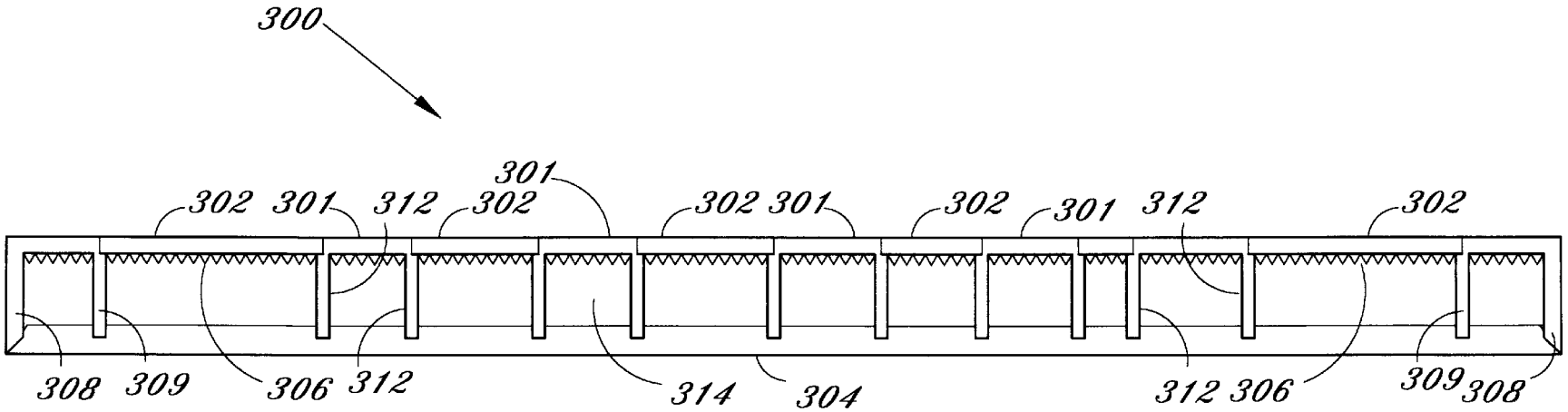
FIG. 12 is a sectional view taken along section lines 12—12 of FIG. 11.
Figure 13:
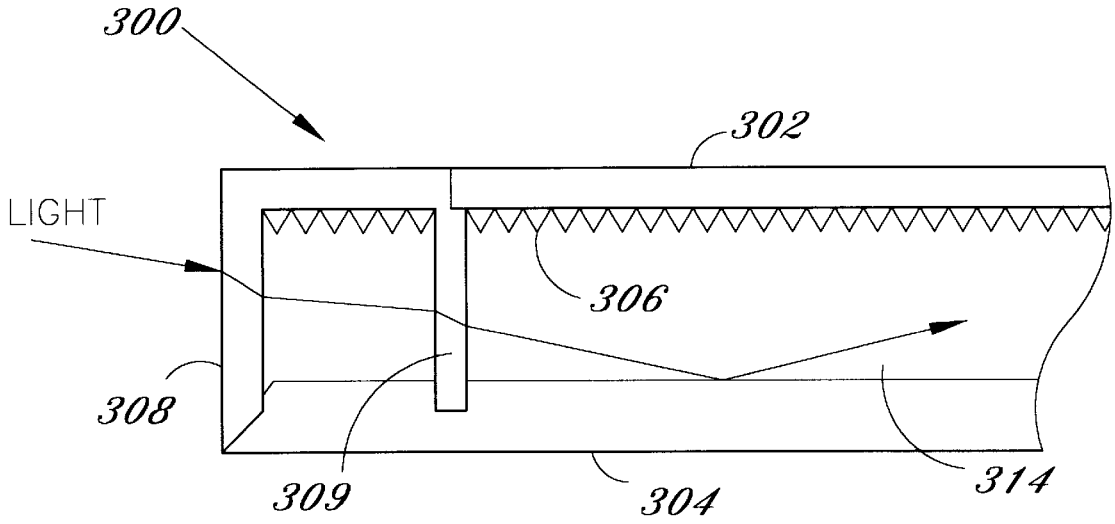
FIG. 13 is a cutaway sectional view of the invention shown in FIG. 12.

FIGS. 11 through 15 illustrate still another embodiment of the present invention. FIG. 11 illustrates this embodiment of the present invention utilizing a stop sign 300 as an example. However, it is to be understood that this embodiment of the present invention can be utilized with any type of sign and is not limited to merely a stop sign. Sign 300 is constructed from plastic, such as polycarbonates, similar to the other embodiments of the present invention. Sign 300 can be formed by molding or other means, also similar to the other embodiments of the present invention. Sign 300 can also incorporate the silicone surface hardener or chemical compounds also similar to the other embodiments of the present invention.

Sign 300 includes a front or face member 302 and a back member 304. Sign 300 can have a message 301, or other indicia, incorporated therein as part of face member 302 of sign 300, or message 301 can be the sign. Face member 302 and back member 304 are separated from each other by a transparent or clear side wall 308, to define a gap area 314 disposed between face member 302, back member 304, and transparent side wall 308. Additionally, a transparent support member 309 may also be provided to help define gap area 314.

Preferably, side wall 308 and/or support member 309 are constructed integral with face member 302. However, such is not limiting, and alternatively, side wall 308 and/or support member 309 may be constructed integral with back member 304. Furthermore, side wall 308 and/or one support member 309 may be constructed independent of face member 302 and back member 304, and later attached thereto.

As side wall 308 and support member 309 are transparent, they allow light to enter within gap area 314 of sign 300. Thus, light entering gap area 314 of sign 300 through side wall 308, provides an illuminating means to make sign 300 more conspicuous. This conspicuity is greatly enhanced during the times when automobiles, and other vehicles would not have their headlights turned "on" to illuminate sign 300.

For example, a sign 300 is mounted on a post located beneath a tree. During early morning or late afternoon hours, gap area 314 allows any available light to enter sign 300 and make sign 300 conspicuous even in the shade of the tree. Thus, sign 300 is extremely beneficial in and around school zones during the times of greatest vehicular activity during the dropping off and picking up the students, when the sun is low, as in the morning, or in the early evening.

As stated above, to support and define gap 314 between face member 302 and back member 304, side wall 308 are provided, and support member 309 may also be provided. Furthermore, one or more additional support members 312, associated with message 301 and depending therefrom, may also be provided. Gap 314 allows one to engineer the appropriate amount of thickness for face member 302, back member 304, side wall 308 and support member 309 to create a stiff and rigid sign 300 having a lower overall weight, as compared to similar conventional signs, thereby making sign 300 lighter and easier to handle.

Figure 14:
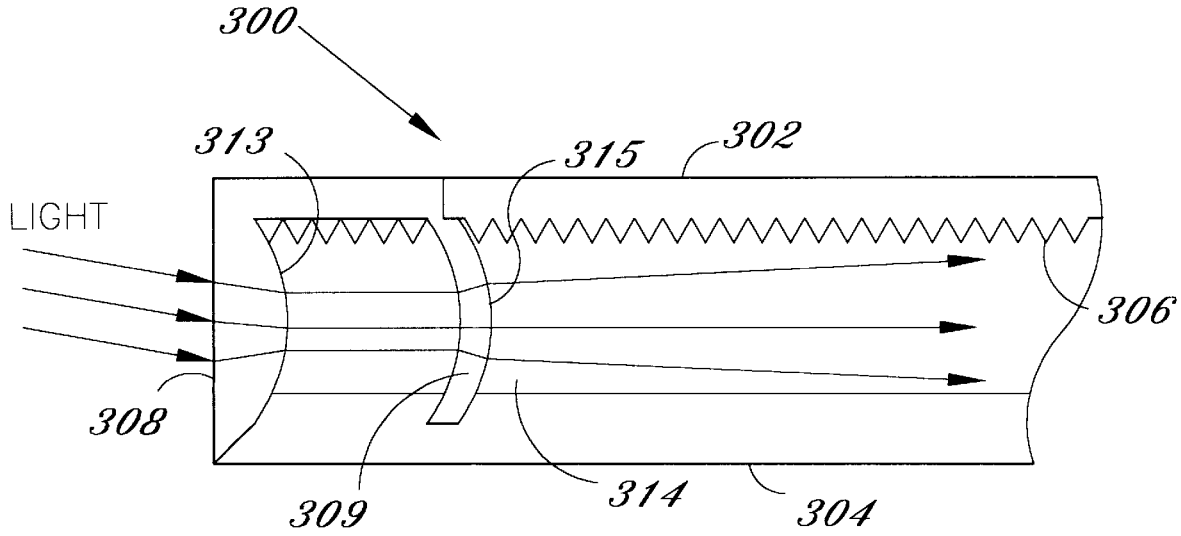
FIG. 14 is a cutaway sectional view of the invention shown in FIG. 11.

Additionally, the shapes and dimensions of side wall 308 and/or support member 309 can be manipulated and molded to provide an optical lens 313 and 315, respectively (FIG. 14). As seen in FIG. 14, lenses 313 and 315 converge and diverge light that enters gap 314 through side wall 308. Lenses 313 and 315 also allow one to create a combination compound or complex lens to create a desired effect within sign 300, as seen in FIG. 14. Furthermore, lenses 313 and 315 can be provided with prescriptions to spread the light within sign 300.

Side wall 308, as well as support member 309, face member 302 and back member 304, can be provided with an exterior finish such that they can also act as light pipes 311 to ignite the optical prescriptions. The use of fluorescent pigments in support member 309, side wall 308, face member 302, and/or back member 304 adds to the conspicuity of sign 300, when sign uses the light hitting it to ignite the optical prescriptions. Sign 300 uses the optical lens effects and internal light piping capabilities of the plastics to direct light to specific locations within sign 300. Thus, light is introduced into sign 300 and is allowed to travel within sign 300 where it can be used to excite the fluorescent pigments to do specific tasks, including, but not limited to, (1) light up the outline of the entire sign; (2) ignite only the letters or other indicia in message 301; (3) ignite only the outline of the letters or other indicia in message 301; (4) add fluorescent effects to the fields around the letters or other indicia in message 301. Thus, the present invention utilizes large plastic bodies, including face member 302 and back member 304, in conjunction with this phenomenon.

The use of these pigments, the internal reflection from the second reflecting means disposed on back member 304, and the ability of gap 314 to allow the light entering the sign to reach specific areas of sign 300 further increases the conspicuity of sign 300. The light need not come from the headlights of an automobile, as sign uses any available light coming from the sun, moon, house lights, street lights, etc. Furthermore, by adding a low power light source, sign 300 or portions of sign 300 can be made to glow.

The pigments need not be used completely through sign 300, or across the entire face, thus allowing for the creation of gradients of the colors used. This feature can be accomplished with various insert and sequential molding techniques, as well as allowing different alloys of materials to be used within the mold. However, once the mold is finished and opened, only a face member is present, with all of the graphical features incorporated within sign 300.

Figure 15:
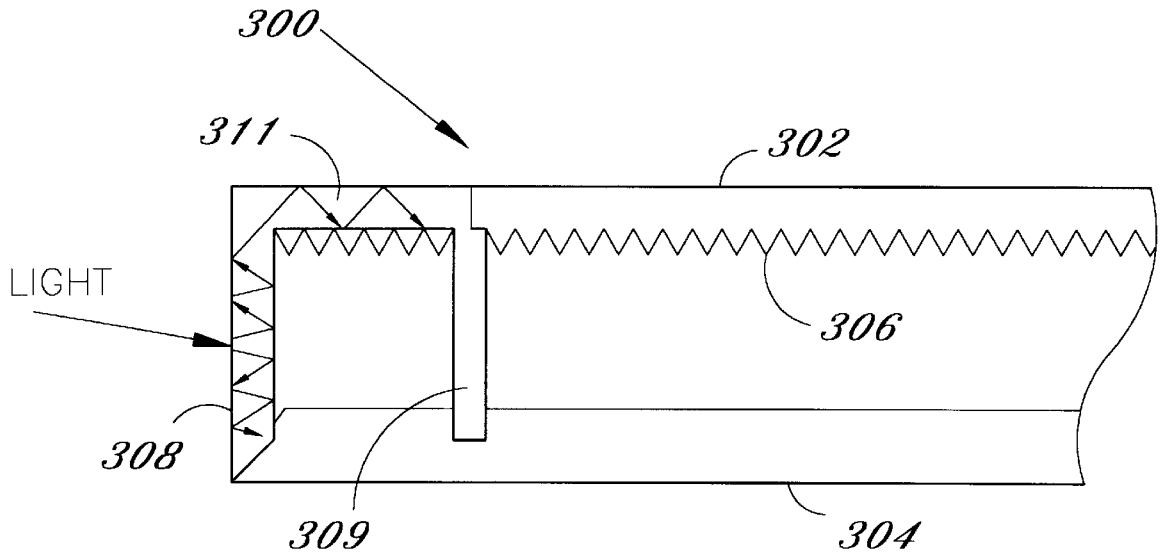
FIG. 15 is a cutaway sectional view of the invention shown in FIG. 11.

All of these features add to the conspicuity of sign 300. Thus, as seen in FIG. 15, side wall 308 and support member 309 are formed to increase internal reflection. Accordingly, this embodiment allows sign 300 to be seen and its message understood with greater ease when viewed from the front.

Figure 16:
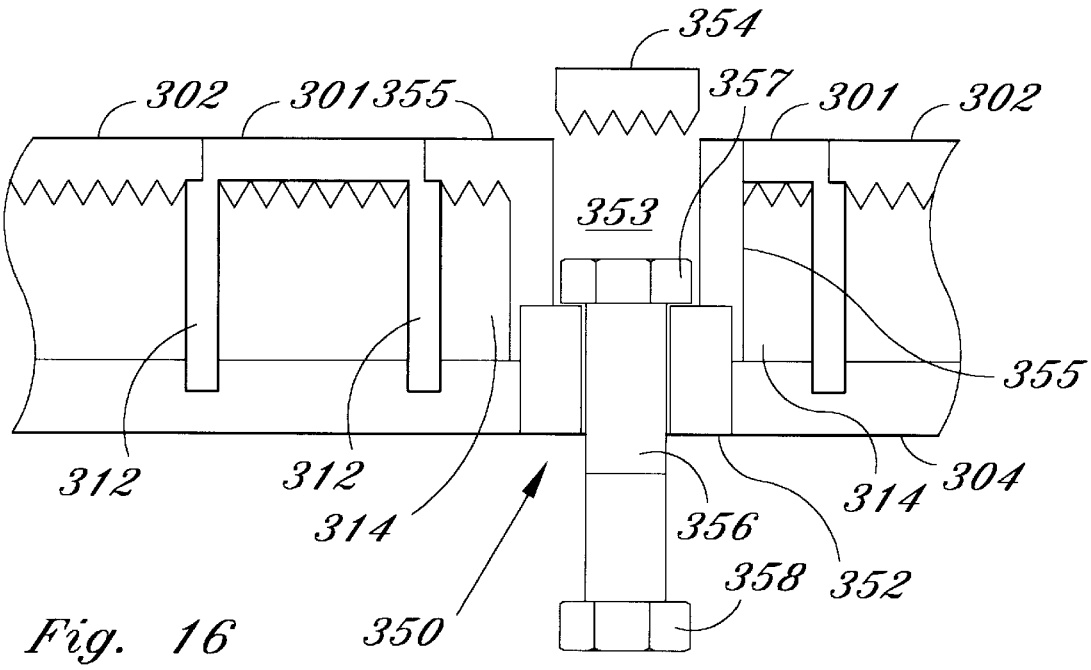
FIG. 16 is a cutaway sectional view of a first sign attachment embodiment of the present invention.

FIG. 16 illustrates a first sign attachment embodiment 350 for attaching sign 300 to a conventional post (not shown). In this attachment embodiment, sign 300 has disposed within, preferably by molding into sign 300, inserts consisting of threaded or unthreaded bosses 352 made from plastic or metal. The molding process forms cavities 353, defined by wall 355, that allow a bolt head 357 of a bolt 356 to fit into, while at the same time preventing bolt 356 from rotating. When properly disposed, bolt head 357 rest upon an inner end of insert 352. After bolt 356 is properly disposed within cavity 353, the opening in the sign is closed by placing a retro-reflective cover or cap 354 that can be snapped into cavity 353 to seal bolt head 357 between cap 354 and insert 352 inside the body of the sign. Cap 354 is preferably provided with reflective means 359 at its back surface.

Boss 352 serves to take the stress of over torquing nut 358 and possibly damaging sign 300. Cavity 353 is molded to accept standard bolts used in this application, thus eliminating the need to use two tools to attach sign 300 as cavity 353 prevents bolt 356 from rotating. Retro-reflective cap 354 serves two purposes: (1) to close off the bolt hole and seal cavity 353, and (2) to, in conjunction with face member 302, complete the face of sign 300 by offering retro-reflective properties consistent with the surrounding and adjacent area of face member 302.

Alternatively, bolt 356 is disposed within insert 352 and both are molded into back member 304 and disposed within molded cavity 353. This alternative first attachment embodiment eliminates the need for cap 354 shown in FIG. 16, as face member 302 serves the same purpose as cap 354. Boss 352 still serves to take the stress of over torquing nut 359 and possibly damaging sign 300. In either first attachment embodiment, the number of bolt, nut, boss and cavity combinations utilized to attached sign 300 to a conventional post (not shown) is not limiting. Preferably, sign 300 is provided with either two or four of such combinations.

In addition to hiding holes, from cavity 353, in sign 300, cap 354 may also be used to repair holes made in sign, such as bullet holes. A repairer would core drill the damaged area to make a uniform opening and then cap 354 would be inserted. Thus, the use of cap 354 to repair damaged areas extends the useful life of sign 300. A similar cap, corresponding in construction to back member 304, can be provided to handle damage done to back member 304.

Figure 17:
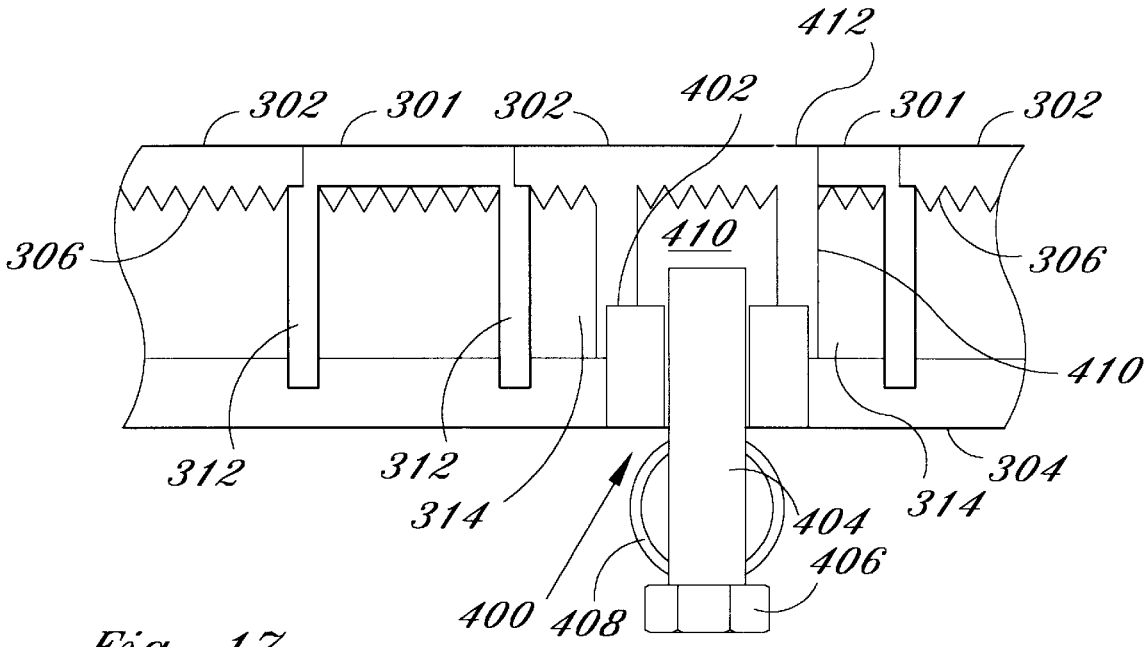
FIG. 17 is a cutaway sectional view of a second sign attachment embodiment of the present invention.

FIG. 17 illustrates a second sign attachment embodiment 400 for attaching sign 300 to a conventional post (not shown). In this attachment embodiment, sign 300 has disposed within, preferably by molding into sign 300, inserts, preferably consisting of threaded bosses 402, made from plastic or metal. The molding process forms cavities 410 defined by wall 412. To attach sign 300 to conventional post 408, bolt 404 is passed through post 408 and through insert 402 into sign 300. In this embodiment, threaded insert 402 acts as a conventional nut. Bolt head 406 is provided to tighten bolt 404, thereby securing sign 300 to post 408. In this embodiment, the sizing of bolt 404's length is important, as compared to the previously described embodiments. Boss 402 also serves to take the stress of over torquing bolt head 406 and possibly damaging sign 300. The number of bolt, boss and cavity combinations utilized to attached sign 300 to post 408 is not limiting. Preferably, sign 300 is provided with either two or four of such combinations.

Figure 18:
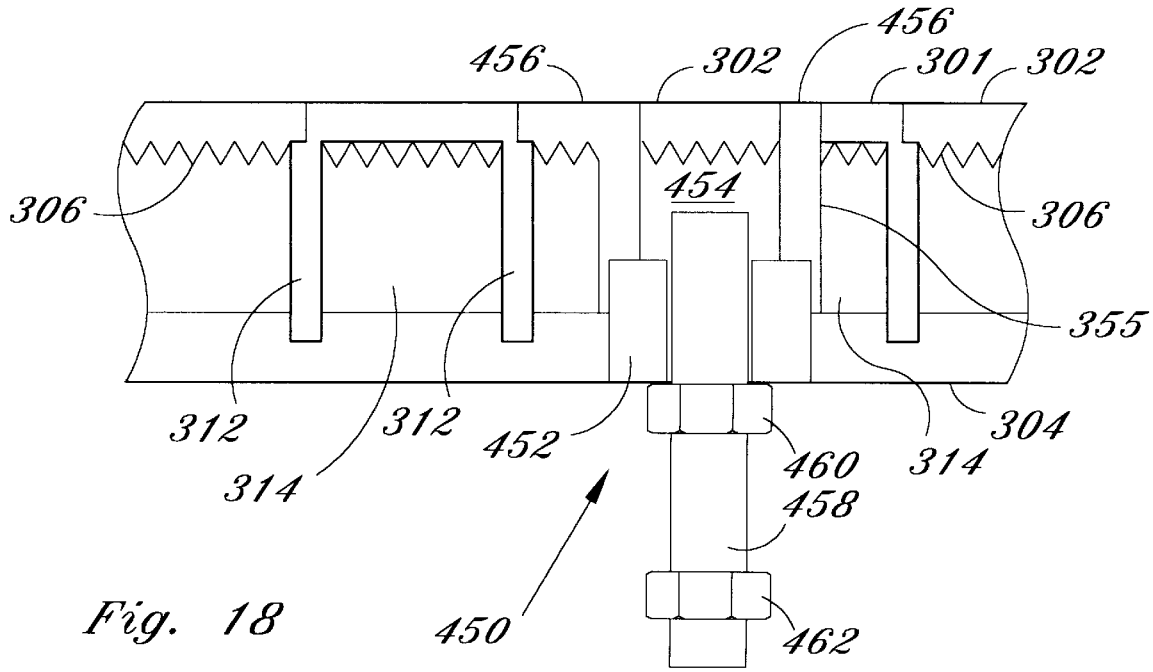
FIG. 18 is a cutaway sectional view of a third sign attachment embodiment of the present invention.

FIG. 18 illustrates a third sign attachment embodiment 450 for attaching sign 300 to a conventional post (not shown, though similar to post 408 shown in FIG. 17). In this attachment embodiment, sign 300 has disposed within, preferably by molding into sign 300, inserts, preferably consisting of threaded bosses 452, made from plastic or metal. The molding process forms cavities 454 defined by wall 456. To attach sign 300 to a conventional post, a double threaded bolt 458, or similar item, is threaded into insert 452 into sign 300 until it stops because of nut 460 which acts as a fixed bolt head 460. After passing the exposed shaft of bolt 458 through a conventional sign post, a standard nut 462 is tighten along bolt 458 to secure sign 300 to the post. As with the second attachment embodiment, the sizing of bolt 458's length is important. Boss 452 and nut 460 also serve to take the stress of over torquing nut 462 and possibly damaging sign 300. The number of bolt, nut, boss and cavity combinations utilized to attached sign 300 to a conventional post is not limiting. Preferably, sign 300 is provided with either two or four of such combinations.

In all of the above-described sign attachment embodiments, the present invention sign 300 has the capability to have an engineered pre-formed cavity to accept a bolt. Also these cavities are reinforced by using an additional boss that handles the stresses of sign 300 moving in the wind. Face member 302 is completely retro-reflective, and the present invention eliminates the unsightly run of rust down the face of the sign. Thus, gap 314 provides the ability to hide the attaching bolt, and side wall 308 and support members 309 and 312, that create gap area 314, provide the opportunity to adjust or tune the required flexibility of the sign for greater life expectancy out in the wind.

Furthermore, the bolts, nuts, inserts can be a series of increasing complex mechanical means used to secure sign 300 to the available post without stressing sign 300. Thus, the boss member may have a significant area or bulk, or have ribs of varying thickness, thus, varying strengths that add to the life of sign 300. These features are available due to gap area 314, which allows one to engineer the sign connectors and hide the mechanical means. The use of connectors and mechanical means can be incorporated in the sign manufacturing step, and does not take away from message 301.

As stated above, face member 302 is formed from plastics that have good optical properties, such as polycarbonates or acrylics, to create specific messages having a desired shape, where areas of sign 300 can be retro-reflective as desired. The inner surface of back member 304 may be provided with a glossy finish that provides sign 300 with a second reflecting means. The edges of face member 302 and back member 304 may be rounded to provide for safer handling. These rounded edges are preferably formed during the molding of face member 302 and back member 304.

Face member 302 and back member 304 are operatively associated via side wall 308 and support member 309 and 312, that provide greater strength and rigidity to sign 300, as well as forming gap 314. Gap 314 allows light to pass from any edge into the body of sign 300, thus allowing sign 300 to be seen with greater conspicuity, especially at low light when automobiles are not using their headlights. This feature is enhanced by shaping side wall 308 and/or at least support members 309 and/or 312 into optical lenses.

Furthermore, back member 304 only allows message 301 to be easily seen when viewing sign 300 from the front of face member 302. Because of the use of retro-reflective means in face member 302, and the additional reflecting means in back member 304, sign 300 is quite conspicuous during nighttime when an automobile headlight does illuminate sign 300.

Thus, it is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim is:

1. A retro-reflective sign having a desired shape and providing for increased conspicuity and legibility of said sign during viewing at nighttime, comprising:

a single layer face member incorporating information therein and having an outer surface and an inner surface, the inner surface of said face member incorporating reflective means formed integral therewith, said face member molded into the desired shape of said sign, said information remaining permanently incorporated within said single layer face member.

2. The retro-reflective sign of claim 1 further including a back member connected to said face member, said back member having an inner surface and an outer surface, said sign having a front side and a back side, wherein said information is seen only when viewing said sign from said front side.

3. The retro-reflective sign of claim 2 wherein said back member and said face member define a gap area therebetween.

4. A retro-reflective sign having a desired shape and providing for an increase conspicuity and legibility of said sign during viewing at nighttime, comprising:

a single layer face member incorporating information therein and having an outer surface and an inner surface, the inner surface of said face member incorporating reflective means formed integral therewith, said face member molded into the desired shape of said sign;

a back member having an inner surface and an outer surface, said sign having a front side and a back side, wherein said information is seen only when viewing said sign from said front side;

a side wall operatively associated with an outer end of said face member and an outer end of said back member; and wherein a gap area is formed between said face member and said back member;

wherein light enters within said gap area through said side wall to enhance the visibility of said sign.

5. The retro-reflective sign of claim 4 further including a support member operatively associated with said face member and said back member.

6. The retro-reflective sign of claim 5 wherein said side wall and said support member are provided with an exterior finish causing said side wall and said support member to act like light pipes.

7. The retro-reflective sign of claim 5 wherein said support member defines an optical lens for converging, diverging and/or redirecting light entering said gap area.

8. The retro-reflective sign of claim 5 wherein said support member is formed integral with said face member.

9. The retro-reflective sign of claim 5 wherein said support member is formed integral with said back member.

10. The retro-reflective sign of claim 4 wherein said side wall is provided with an exterior finish causing said side wall to act like a light pipe.

11. The retro-reflective sign of claim 4 wherein said side wall defines an optical lens for converging, diverging and/or redirecting light entering said gap area.

12. The retro-reflective sign of claim 4 wherein said side wall is formed integral with said face member.

13. The retro-reflective sign of claim 4 wherein said side wall is formed integral with said back member.

14. The retro-reflective sign of claim 4 further including means for attaching said sign to a sign post.

15. The retro-reflective sign of claim 14 wherein said means for attaching comprises:

a cavity formed within said sign;

a threaded insert member disposed within said cavity; and a bolt member extending through said post, said back member and at least a portion of said insert member, said bolt member having a bolt head abutting an outer surface of said post when said bolt member is properly disposed to securely retain said sign to said post.

16. The retro-reflective sign of claim 14 wherein said means for attaching comprises:

a cavity formed within said sign;

a threaded insert member disposed within said cavity;

a bolt member having a first portion and a second portion, said first portion extending through said back member and at least a portion of said insert member, said first portion and said second portion of said bolt member defined and divided by a fixed bolt head member disposed along said bolt member, said bolt head member abutting an outer surface of said back member when said first portion of said bolt member is properly disposed, said second portion of said bolt member extending through said post; and a nut member operatively associated with an outer end of said second portion of said bolt member to securely retain said sign to said post.

17. A retro-reflective sign having a desired shape and providing for increased conspicuity and legibility of said sign during viewing at nighttime, comprising:

a single layer face member incorporating information therein and having an outer surface and an inner surface, the inner surface of said face member incorporating reflective means formed integral therewith, said face member molded into the desired shape of said sign;

a back member having an inner surface and an outer surface, said sign having a front side and a back side, wherein said information is seen only when viewing said sign from said front side;

a side wall operatively associated with an outer end of said face member and an outer end of said back member; and means for attaching said sign to a sign post wherein a gap area is formed between said face member and said back member and said side wall;

wherein light enters within said gap area through said side wall to enhance the visibility of said sign;

wherein said means for attaching comprises:

a cavity formed within said sign;

an insert member disposed within said cavity;

a bolt member disposed within said cavity and extending through said insert member and said back member, said bolt member having a bolt head abutting one end of said insert member when properly disposed within said cavity; and a cap member operatively associated with said face member adjacent said cavity.

18. The retro-reflective sign of claim 17 wherein said means for attaching further including a nut member operatively associated with said bolt member to securely retain said sign to said post.

19. A retro-reflective sign having a desired shape and providing for increased conspicuity and legibility of said sign during viewing at nighttime, comprising:

a single layer face member incorporating information therein and having an outer surface and an inner surface, the inner surface of said face member incorporating reflective means formed integral therewith, said face member molded into the desired shape of said sign;

a back member having an inner surface and an outer surface, said sign having a front side and a back side, wherein said information is seen only when viewing said sign from said front side;

a side wall operatively associated with an outer end of said face member and an outer end of said back member;

means for attaching said sign to a sign post; and a support member operatively associated with said face member and said back member; and wherein a gap area is formed between said face member and said back member and said side wall;

wherein light enters within said gap area through said side wall to enhance the visibility of said sign.

20. The retro-reflective sign of claim 19 wherein said side wall defines a first optical lens and said support member defines a second optical lens, said first optical lens and said second optical lens converging, diverging and/or redirecting light entering said gap area.

21. The retro-reflective sign of claim 19 wherein said side wall and said support member are provided with an exterior finish causing said side wall and said support member to act like light pipes.

* * * * *